US008684323B2

(12) United States Patent
McConnell

(10) Patent No.: US 8,684,323 B2
(45) Date of Patent: Apr. 1, 2014

(54) BAG HOLDER FOR A T-SHIRT BAG

(76) Inventor: Peter McConnell, San Diego, CA (US)

( * ) Notice: Subject to any disclaimer, the term of this patent is extended or adjusted under 35 U.S.C. 154(b) by 917 days.

(21) Appl. No.: 12/693,348

(22) Filed: Jan. 25, 2010

(65) Prior Publication Data

US 2011/0024580 A1 Feb. 3, 2011

Related U.S. Application Data

(63) Continuation-in-part of application No. 11/526,284, filed on Sep. 25, 2006, now Pat. No. 7,404,531, and a continuation-in-part of application No. 11/715,717, filed on Mar. 8, 2007, now Pat. No. 7,661,635.

(60) Provisional application No. 60/779,833, filed on Mar. 8, 2006, provisional application No. 61/162,272, filed on Mar. 21, 2009.

(51) Int. Cl.
*B65B 67/04* (2006.01)

(52) U.S. Cl.
USPC ..... 248/99; 248/95; 248/97; 248/907; 220/495.1; 220/495.08; 220/495.09

(58) Field of Classification Search
USPC ..... 248/95, 99, 100, 339, 341, 97, 907, 248/914; 383/33, 73; 141/316, 390, 391; 220/495.08, 495.1, 495.09
See application file for complete search history.

(56) References Cited

U.S. PATENT DOCUMENTS

| | | | |
|---|---|---|---|
| 121,529 | A | 12/1871 | William |
| 435,474 | A | 9/1890 | Young |
| 477,235 | A | 6/1892 | Timmerman |
| 490,578 | A | 1/1893 | Merry |
| 544,585 | A | 8/1895 | Mayo |
| 576,782 | A | 2/1897 | Goodrich |
| 657,284 | A | 9/1900 | Eddy |
| 973,414 | A | 10/1910 | Eastham |
| 1,008,101 | A | 11/1911 | Adams |
| 1,045,281 | A | 11/1912 | Gunderson |
| 1,240,852 | A | 9/1917 | Israelson |
| 1,266,522 | A | 5/1918 | Oldham |
| 1,713,095 | A | 5/1929 | Scheffler |
| 1,760,752 | A | 5/1930 | Happer |
| 2,289,695 | A | 7/1942 | Bryant |
| 2,305,863 | A | 12/1942 | Ginter |

(Continued)

*Primary Examiner* — Terrell McKinnon
*Assistant Examiner* — Michael McDuffie
(74) *Attorney, Agent, or Firm* — Roeder & Broder LLP

(57) ABSTRACT

A bag holder for holding a t-shirt bag includes a holder frame and a holder handle that is secured to the holder frame. The holder frame selectively holds the t-shirt bag and including a first handle restraint that restrains a first bag handle of the t-shirt bag, a second handle restraint that restrains a second bag handle of the t-shirt bag, and a bag support region that supports the t-shirt type bag near the bag opening. The holder handle is movable relative to the holder frame between a carrying position in which the holder handle is used for carrying the holder frame and the t-shirt bag, and an attachment position in which that holder handle is used for hanging the holder frame and the t-shirt bag near a vertical surface. Further, the holder frame is movable between (i) an expanded configuration in which the bag support region and the handle restraints cooperate to maintain the bag opening open, and (ii) a compact configuration in which at least one of the handle restraints has been moved relative to the bag support region.

16 Claims, 14 Drawing Sheets

(56) References Cited

U.S. PATENT DOCUMENTS

| | | | | | |
|---|---|---|---|---|---|
| 2,838,264 | A | * | 6/1958 | Hill | 248/147 |
| 3,017,653 | A | | 1/1962 | Bird | |
| D214,645 | S | | 7/1969 | Gay et al. | |
| D214,849 | S | | 8/1969 | Barrett | |
| 3,796,402 | A | | 3/1974 | Trotta | |
| 4,050,492 | A | | 9/1977 | Veilleux | |
| 4,069,993 | A | | 1/1978 | Shanks | |
| 4,238,868 | A | | 12/1980 | Sternberg | |
| 4,445,658 | A | * | 5/1984 | Ferron | 248/99 |
| 4,458,867 | A | * | 7/1984 | Malik | 248/97 |
| 4,467,989 | A | * | 8/1984 | Stroh | 248/97 |
| 4,487,388 | A | * | 12/1984 | Provan | 248/97 |
| D286,217 | S | | 10/1986 | Waun et al. | |
| 4,760,983 | A | * | 8/1988 | McNerney | 248/100 |
| 4,832,291 | A | | 5/1989 | Nelson et al. | |
| 4,877,207 | A | | 10/1989 | Farah | |
| 4,892,277 | A | * | 1/1990 | Tobis | 248/101 |
| 4,919,546 | A | | 4/1990 | Imazeki et al. | |
| 4,923,087 | A | * | 5/1990 | Burrows | 220/495.1 |
| 4,938,380 | A | * | 7/1990 | Donahoe | 220/495.1 |
| 4,957,252 | A | * | 9/1990 | Watkins | 248/97 |
| 4,971,274 | A | | 11/1990 | Mitchell | |
| 5,012,994 | A | * | 5/1991 | Keefe | 248/558 |
| 5,014,943 | A | | 5/1991 | Nelson et al. | |
| 5,020,751 | A | | 6/1991 | Larkin | |
| 5,031,948 | A | | 7/1991 | Groth et al. | |
| 5,100,087 | A | * | 3/1992 | Ashby | 248/97 |
| D326,752 | S | | 6/1992 | Griggs | |
| 5,154,378 | A | | 10/1992 | Plum | |
| 5,163,645 | A | | 11/1992 | Caruso | |
| 5,190,253 | A | * | 3/1993 | Sable | 248/97 |
| D345,838 | S | | 4/1994 | Bunn | |
| 5,350,142 | A | | 9/1994 | Kurtzman et al. | |
| 5,400,989 | A | | 3/1995 | Gaskill | |
| 5,445,398 | A | | 8/1995 | Pierce | |
| 5,493,751 | A | | 2/1996 | Misiukowiec et al. | |
| 5,513,823 | A | * | 5/1996 | Bresnahan | 248/99 |
| 5,522,729 | A | | 6/1996 | Maddox | |
| 5,551,654 | A | * | 9/1996 | McNerney | 248/99 |
| 5,711,563 | A | | 1/1998 | Sapp | |
| 5,718,400 | A | | 2/1998 | Dwy | |
| D391,722 | S | | 3/1998 | Sheppard | |
| 5,799,908 | A | * | 9/1998 | Downs | 248/97 |
| 5,799,993 | A | | 9/1998 | Lafferty | |
| D401,719 | S | * | 11/1998 | Van Leeuwen et al. | D34/1 |
| 5,875,902 | A | | 3/1999 | Emery et al. | |
| 5,881,901 | A | * | 3/1999 | Hampton | 220/495.08 |
| 5,947,602 | A | | 9/1999 | Coxsey | |
| 5,997,061 | A | | 12/1999 | Langley | |
| D420,480 | S | | 2/2000 | Necaise | |
| 6,039,370 | A | | 3/2000 | Dooley et al. | |
| 6,042,063 | A | * | 3/2000 | Kerr et al. | 248/100 |
| 6,142,350 | A | | 11/2000 | Alexander | |
| 6,152,408 | A | | 11/2000 | O'Grady | |
| 6,155,521 | A | | 12/2000 | O'Hanlon | |
| D436,706 | S | | 1/2001 | Clinton | |
| 6,199,802 | B1 | | 3/2001 | Scheibe | |
| 6,209,596 | B1 | | 4/2001 | Wong | |
| 6,330,990 | B1 | * | 12/2001 | Haubrich | 248/99 |
| 6,375,131 | B1 | | 4/2002 | Youst | |
| 6,454,223 | B1 | * | 9/2002 | Rosky | 248/100 |
| 6,488,241 | B1 | | 12/2002 | Kyte et al. | |
| 6,488,243 | B2 | | 12/2002 | Kim | |
| 6,517,033 | B2 | | 2/2003 | Russell et al. | |
| 6,517,034 | B1 | | 2/2003 | Kitchen | |
| 6,585,197 | B1 | * | 7/2003 | Daniels | 248/97 |
| 6,666,416 | B1 | * | 12/2003 | McAllister | 248/95 |
| 6,726,156 | B1 | | 4/2004 | Scola | |
| 6,932,126 | B1 | | 8/2005 | Spagnolo | |
| 7,007,991 | B1 | | 3/2006 | Sapp | |
| D519,701 | S | | 4/2006 | Trudeau | |
| 7,118,001 | B2 | * | 10/2006 | Klein et al. | 211/90.03 |
| 7,175,139 | B2 | * | 2/2007 | Broeders | 248/95 |
| D543,328 | S | | 5/2007 | Kulkey | |
| 7,318,569 | B1 | * | 1/2008 | Bilotta | 248/97 |
| D568,023 | S | | 4/2008 | McConnell | |
| 7,404,531 | B2 | | 7/2008 | McConnell | |
| 7,661,635 | B2 | | 2/2010 | McConnell | |
| 7,677,507 | B1 | * | 3/2010 | Rothbauer et al. | 248/99 |
| 2004/0000556 | A1 | * | 1/2004 | Harris | 220/495.1 |
| 2007/0235600 | A1 | * | 10/2007 | Herold et al. | 248/97 |
| 2009/0050628 | A1 | * | 2/2009 | Sullivan | 220/495.1 |

* cited by examiner

BAG HOLDER FOR A T-SHIRT BAG

RELATED APPLICATIONS

This application claims priority on U.S. Provisional Application No. 60/779,833 filed on Mar. 8, 2006. This application is also a continuation in part of U.S. application Ser. No. 11/526,284, filed on Sep. 25, 2006 now U.S. Pat. No. 7,404,531 and entitled "Trash Bag Holder With Handle". The contents of U.S. Provisional Application No. 60/779,833 and U.S. application Ser. No. 11/526,284, are incorporated herein by reference.

This application claims priority on U.S. Provisional Application No. 61/162,272 filed on Mar. 21, 2009. This application is also a continuation in part of U.S. application Ser. No. 11/715,717, filed on Mar. 8, 2007 now U.S. Pat. No. 7,661,635 and entitled "Bag Holder For a T-Shirt Bag". The contents of U.S. Provisional Application No. 61/162,272 and U.S. application Ser. No. 11/715,717, are incorporated herein by reference.

BACKGROUND

Plastic t-shirt type bags are commonly used in many stores, such as department, grocery, and hardware stores to package the goods that were purchased by the customer at the store. After use, the t-shirt bags are often thrown away or sometimes recycled. Unfortunately, there is currently not a convenient way to reuse these t-shirt type bags.

SUMMARY

The present invention is directed a bag holder for holding a t-shirt bag. A typical t-shirt bag includes a bag opening, a first bag handle and a second bag handle. The bag holder includes a holder frame and a holder handle that is secured to the holder frame. The holder frame selectively holds the t-shirt bag and including a first handle restraint that restrains the first bag handle, and a second handle restraint that restrains the second bag handle. In one embodiment, the holder handle is movable relative to the holder frame between a carrying position in which the holder handle is used for carrying the bag frame and the t-shirt bag, and an attachment position in which that holder handle is used for hanging the holder frame and the t-shirt bag near a vertical surface. With this design, in certain embodiments, the bag holder facilitates the reuse of t-shirt bags, the bag holder can easily be carried and moved by hand, and the bag holder can be easily secured to a door.

In one embodiment, the holder frame including a first handle restraint that restrains the first bag handle, a second handle restraint that restrains the second bag handle, and a bag support region that supports the t-shirt type bag near the bag opening. In this embodiment, the holder frame is movable between (i) an expanded configuration in which the bag support region and the handle restraints cooperate to maintain the bag opening open, and (ii) a compact configuration in which at least one of the handle restraints has been moved relative to the bag support region.

In certain embodiments, during movement from the expanded configuration to the compact configuration, each handle restraint has been moved relative to the bag support region. Further, during movement from the expanded configuration to the compact configuration, the bag support region has been moved relative to each handle restraint.

Additionally, the holder frame can include a backbone region and a frame base region. In this embodiment, during movement from the expanded configuration to the compact configuration, each handle restraint has been moved relative to the backbone region. Further, during movement from the expanded configuration to the compact configuration, the bag support region has been moved relative to the backbone region.

Moreover, in certain embodiments, the holder handle pivots relative to the holder frame in a first rotational direction during movement of the holder handle from the attachment position to the carrying position, and wherein the holder handle includes an engagement region that engages the backbone region of the holder frame to inhibit rotation of the holder handle past the carrying position in the first rotational direction while simultaneously allowing the holder handle to freely rotate between the attachment position and the carrying position.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION

Figure 1:
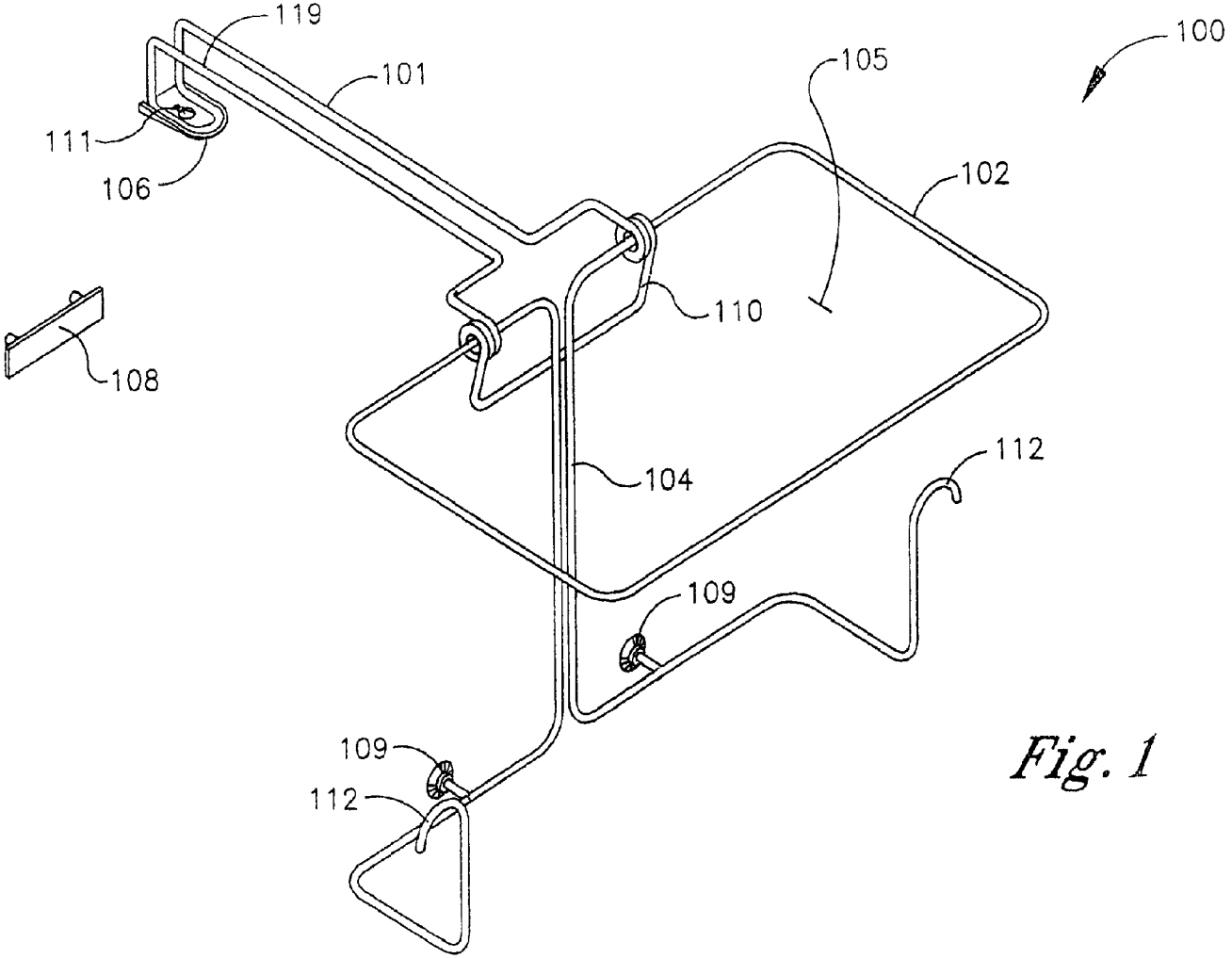
FIG. 1 is a perspective view of one embodiment of a bag holder having features of the present invention.

FIG. 1 illustrates a first embodiment of a bag holder 100 for retaining a t-shirt type bag (not shown). In this embodiment, the bag holder 100 includes a bag handle 101 and a holder frame 102. In one embodiment, the bag holder 100 is made of a wire frame construction that confers light weight and rigidity. The handle 101 is connected to the holder frame 102 such that a handle restraint bar 110 of the bag handle 101 can connect with a backbone 104 of the holder frame 102 to permit the bag holder 100 to be held by hand while a top opening 105 of the holder frame 102 is horizontal.

In certain embodiments, there are three modes in which the bag holder 100 hangs from a fixed support. In a first vertical mode, the bag handle 101 is allowed to hang vertically, a handle attachment device 106 of the bag handle 101 is inserted into an attachment slot formed between a vertical surface (not shown in FIG. 1) and an attachment beam 108 that is attached to the vertical surface. In this mode, one or more bag holder frame bumpers 109 of the holder frame 102 rest against the vertical surface to maintain the orientation of the holder frame 102.

In a second vertical mode, the bag handle can define a handle attachment opening 111, is placed over a protruding object such as a screw or a nail (not shown) attached to the vertical surface. The weight of the holder frame 102, the attached t-shirt bag, and the contents of the t-shirt bag is borne by the screw and the bag handle 101.

In a third vertical mode, a distal end of the bag handle 101 is generally "U" shaped and defines a hook space 119 that can be used to hook over a horizontal straight edge (not shown in FIG. 1) such as a cupboard door top or a closet door. In this mode, the weight of the bag frame 102 and the t-shirt bag is borne by the distal end of the bag handle 101.

In certain embodiments, the bag holder 100 includes two handle restraints 112 that hold the handles of a standard t-shirt bag. The t-shirt bag is attached to the bag holder 100 by pulling the t-shirt bag up through the top opening 105 by means of the t-shirt bag handles and then folding each handle of the t-shirt bag over the rim of the top opening 105 such that the t-shirt bag handle loop is hooked around each handle restraint 112.

The t-shirt bag is then held firmly by the bag holder 100 and can be filled with trash when the bag handle 101 is in a carrying position where it can be is carried by hand, or in one of the vertical modes, positioned adjacent to a vertical surface.

Figure 2:
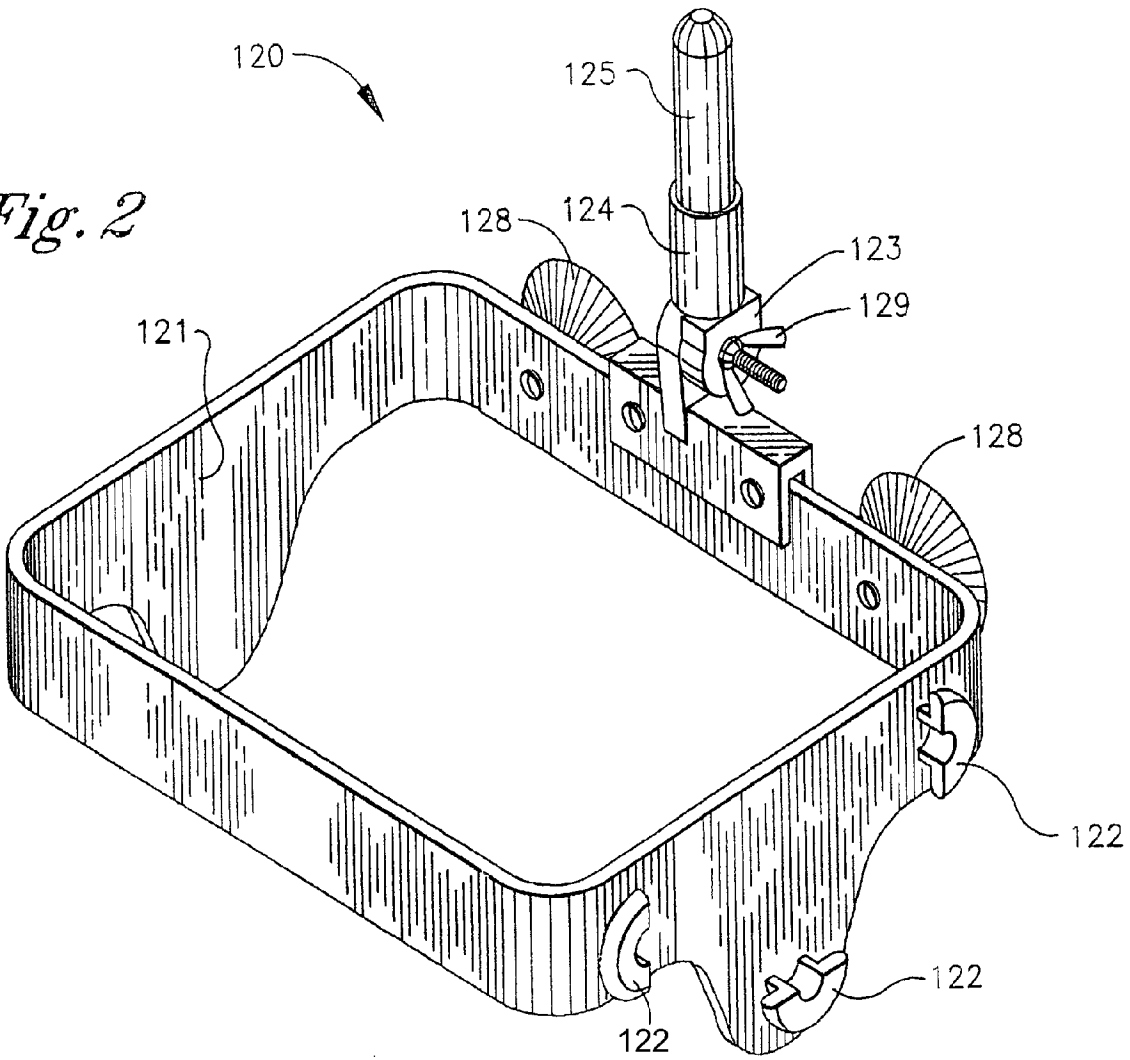
FIG. 2 is a perspective view of another embodiment of a bag holder having features of the present invention.

An alternative embodiment of the bag holder 120 is illustrated in FIGS. 2-5. In this embodiment, the rectangular frame 121 is made of plastic, with the bag attachment points 122 cast separately and attached fixedly with glue or other means. The handle connection mechanism 123 is shown in FIG. 2 to be screwed on but in this embodiment is glued after separate casting. The handle rotation control mechanism 125 is ratcheted with attached butterfly nut 129, permitting the handle 126 to be moved between the carrying and the attachment position.

Figure 3:
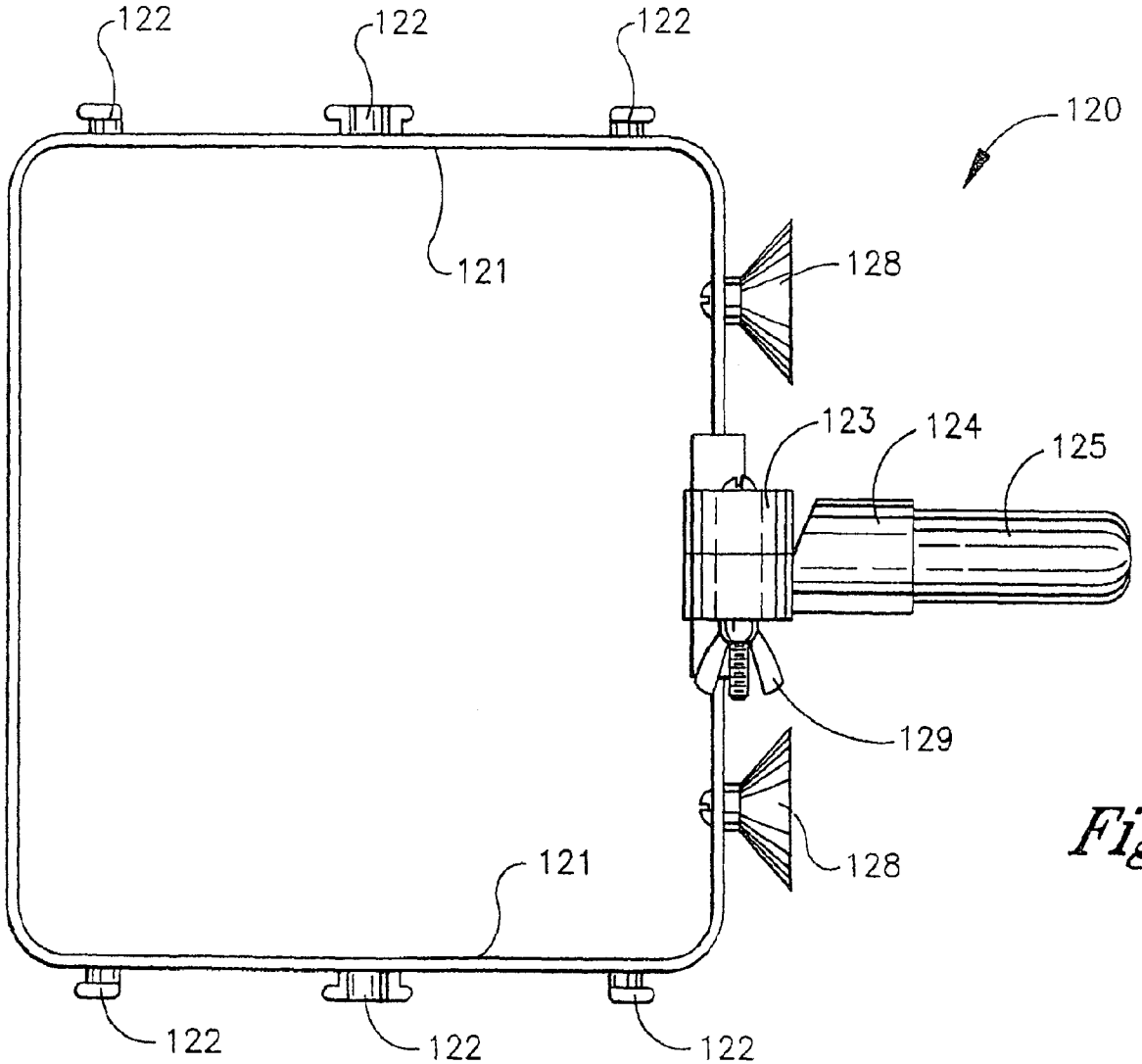
FIG. 3 is a top view of the bag holder of FIG. 3.

FIG. 3 illustrates the top view of the bag holder 120, with the profile of the bag attachment points 122. These bag attachment points 122 are designed to allow a standard thickness shopping bag handle to be wound around them to secure the bag.

Figure 5:
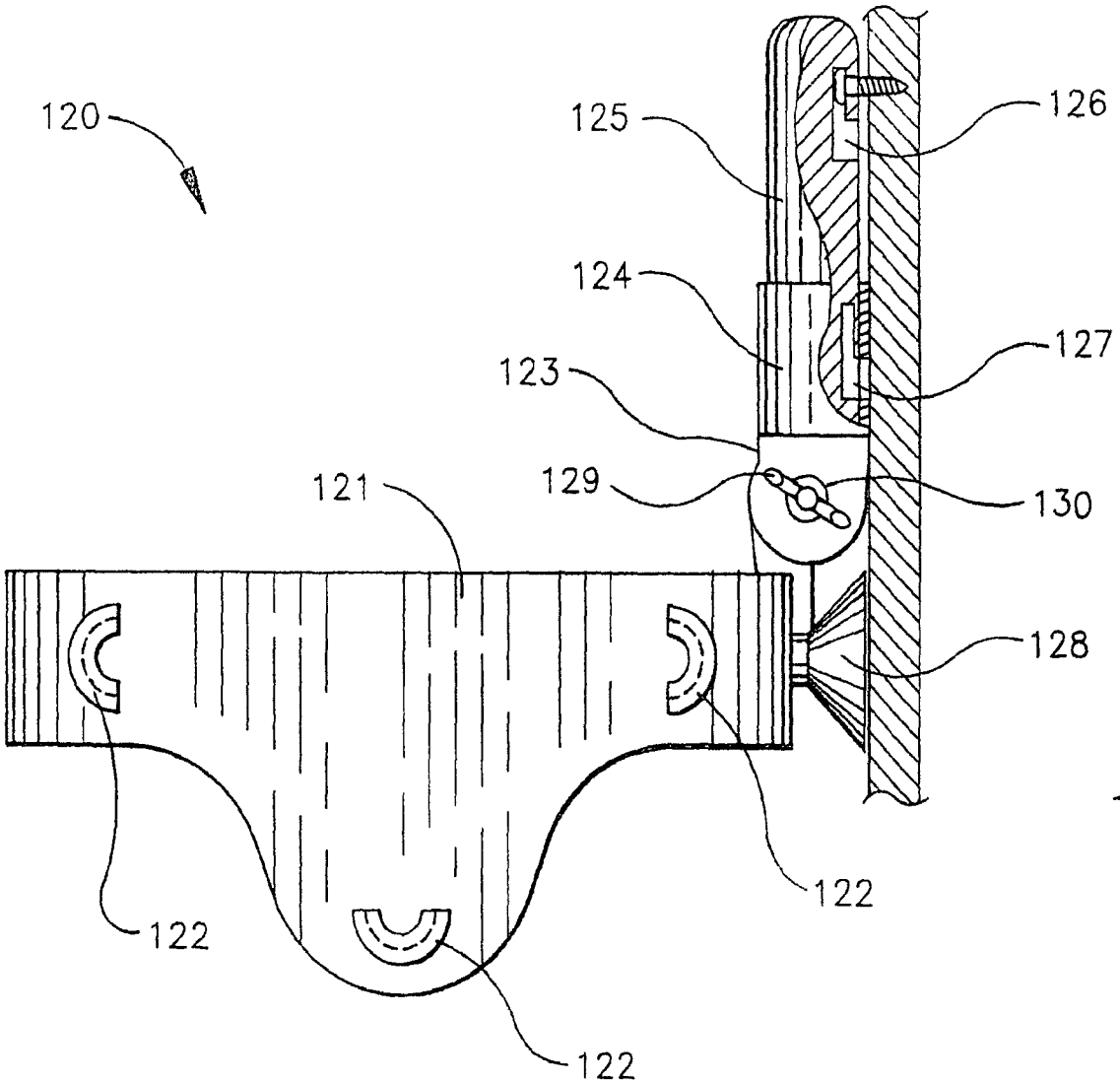
FIG. 5 is a side view of the bag holder of FIG. 2 with the holder handle in an attachment position.

The handle 123 as shown is optionally in two pieces: a handle receiver 124 made of plastic and a handle part 125 made optionally of wood but can be also made of plastic. The handle part 125 optionally screws into the handle receiver 124. The handle part 125 possesses two handle attachment points 126, 127 as shown in FIG. 5 in cutaway view. In an alternative embodiment, the handle receiver 124 and handle part 125 are cast together into a single handle with the two handle attachment points 126, 127 cast into it.

The upper handle attachment point 126 is used for the standard short shopping bags and the lower one for longer plastic bags. The handle 123 is in the "up" position in FIG. 5 and the circular bumpers 128 in the handle side of the frame allow the invention 120 to stand away form the surface of the wall or door the invention 120 is suspended from. The circular bumpers 128 confer increased stability and inhibit the frame 121 from rotating around the suspension point at the handle attachment point 126, 127.

Figure 4:
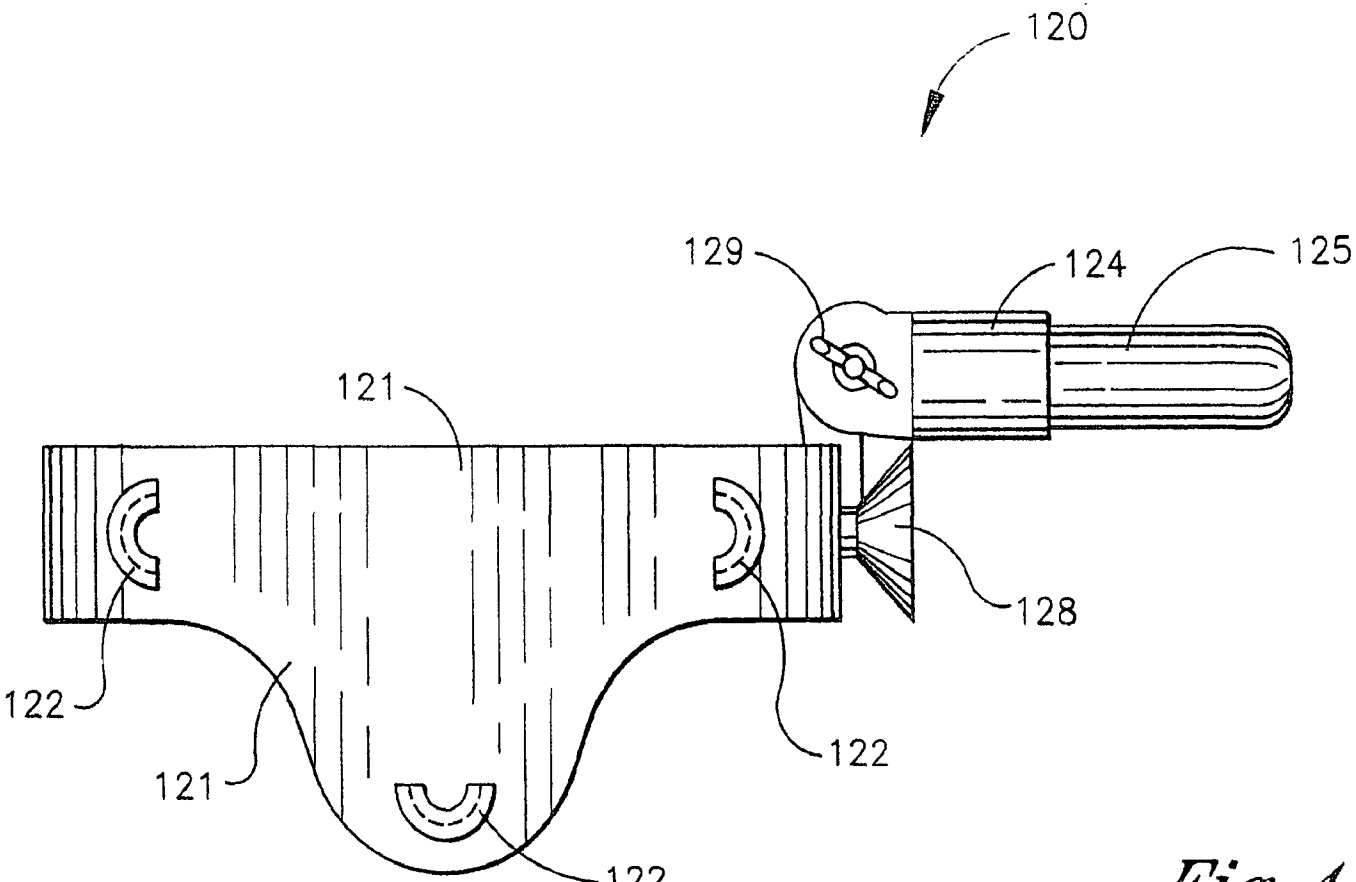
FIG. 4 is a side view of the bag holder of FIG. 2 with a holder handle in a carrying position.

FIG. 4 illustrates the invention 120 with the handle 123 in the carrying position, where it can be used to carry the frame 121 and attached bag for easy use in collecting litter. The handle rotation control mechanism 130 is strong enough so that when the butterfly nut 129 is tightened down, the ratchet will not rotate while the bag is attached to it and being carried away.

Figure 6A:
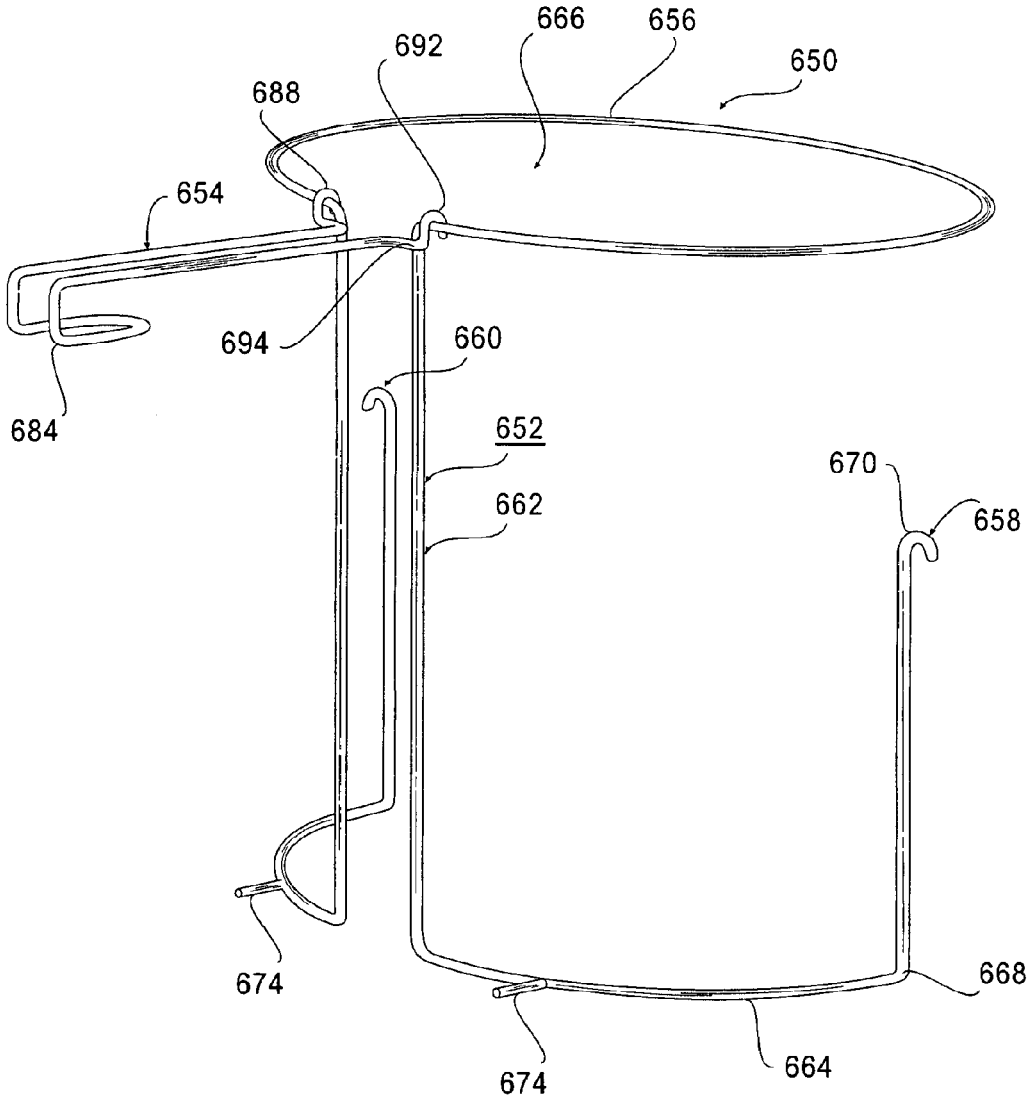
FIGS. 6A and 6B are alternative perspective views.
Figure 6B:
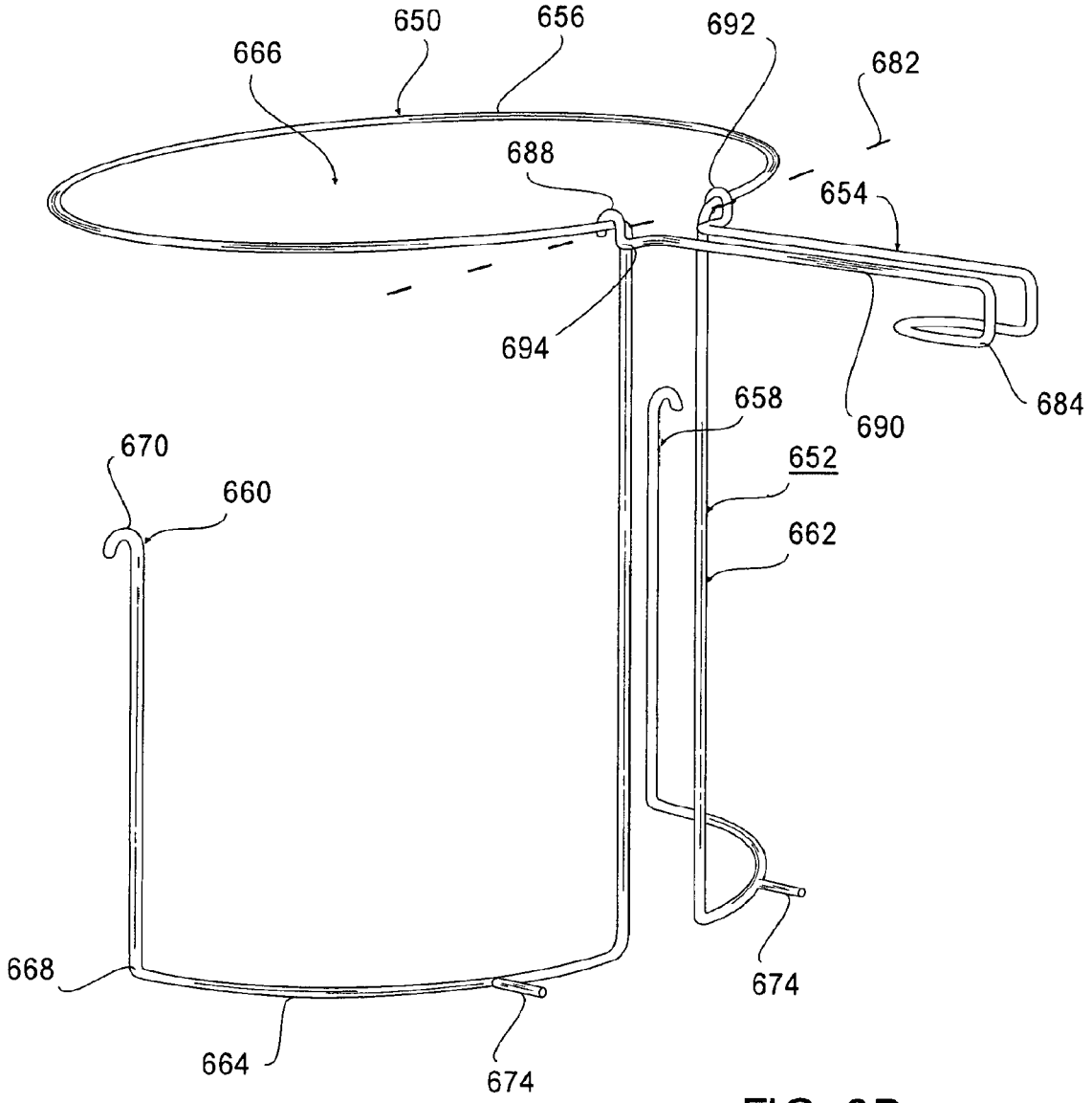
Figure 6C:
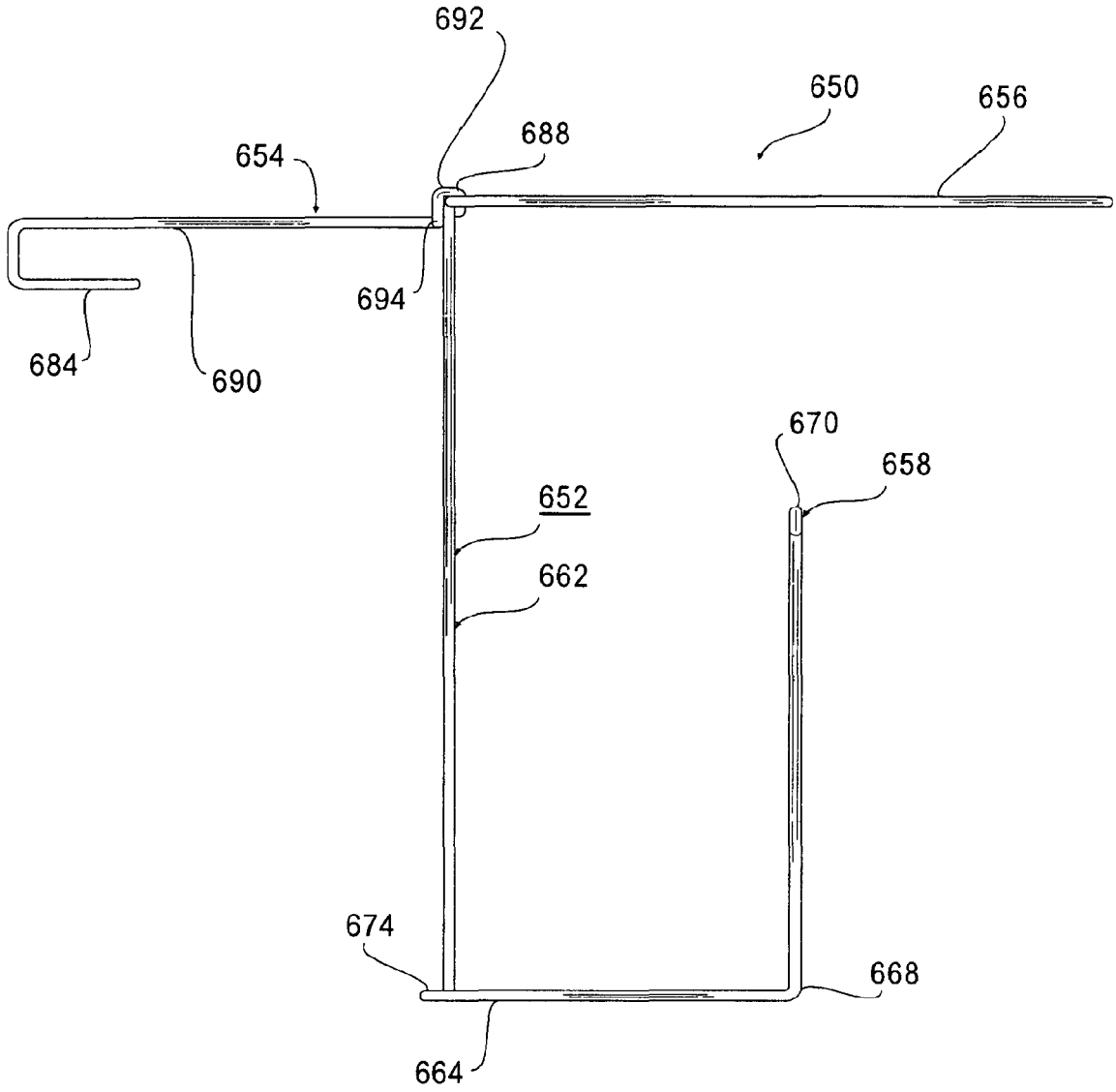
FIG. 6C is a side view of yet another embodiment of a bag holder having features of the present invention with a bag handle in the carrying position.
Figure 6D:
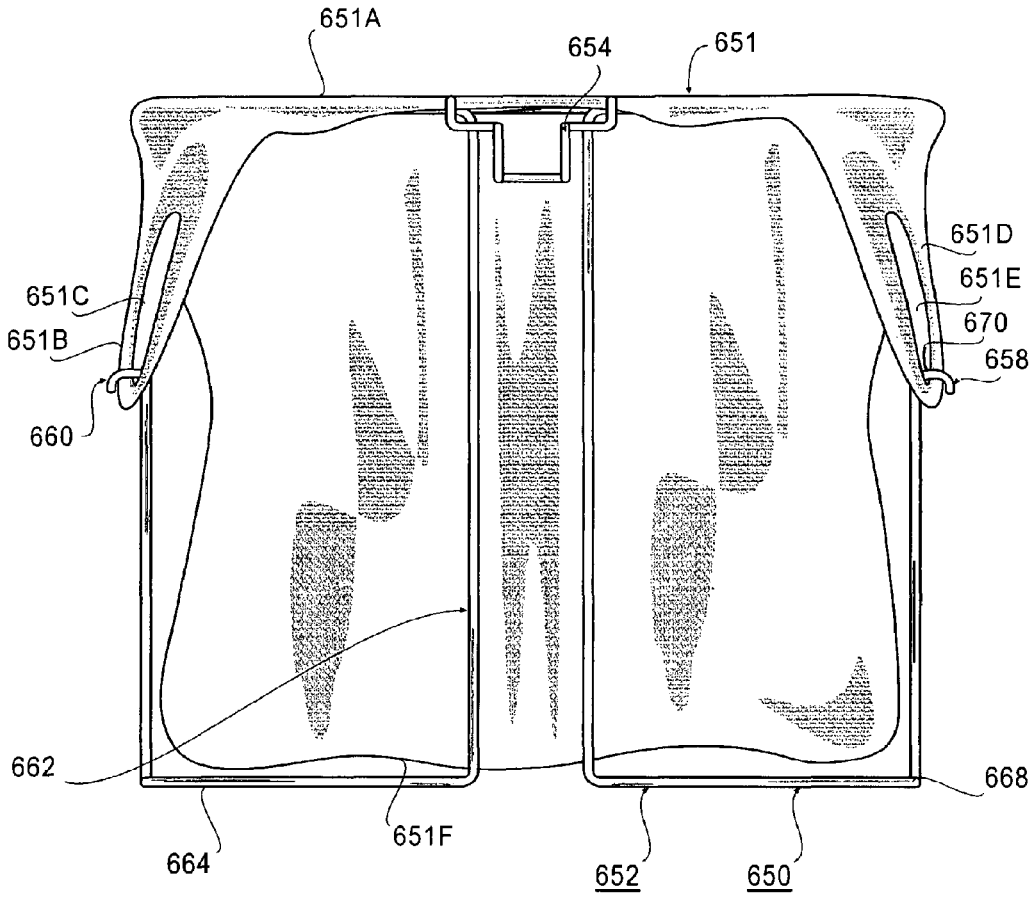
FIG. 6D is a top view of the bag holder of FIGS. 6A-6C with a T-shirt type bag retained by the bag holder.

FIGS. 6A and 6B are alternative perspective views, and FIG. 6C is a side view of yet another embodiment of a bag holder 650 that is somewhat similar to the bag holders described above and illustrated in FIGS. 1-5. FIG. 6D illustrates this embodiment of the bag holder 650 with a t-shirt type bag 651 retained by the bag holder 650. In this embodiment, as illustrated in FIG. 6D, the t-shirt bag 651 includes a bag opening 651A, a first bag handle 651B that defines a first handle opening 651C, a second bag handle 651D that defines a second handle opening 651E, and a bag bottom 651F. Further, in this embodiment, the bag handles 651B, 651D are spaced apart and positioned on opposite sides of the bag opening 651A.

As used herein, the term "t-shirt bag" shall include any bag commonly referred to as a t-shirt bag, any shopping/grocery bag with handles, any plastic bag with handles, or any carrying bag with handles.

In one embodiment, the bag holder 650 includes a holder frame 652 and a holder handle 654. The size, shape, design, and materials used in each of these components can vary pursuant to the teachings provided herein. In this embodiment, the holder frame 652 includes a bag support region 656, a first handle restraint 658, a second handle restraint 660, a backbone region 662, and a frame base region 664.

The bag support region 656 supports the t-shirt type bag 651 with the bag opening 651A held open. The bag support region 656 can also be referred to as the bag support frame. For example, the bag support region 656 can support the t-shirt bag 651 near the bag opening 651A. In one embodiment, the bag support region 656 is somewhat annular ring shaped and forms a frame opening 666 for receiving a portion of the t-shirt bag 651.

The first handle restraint 658 restrains the first bag handle 651B, and the second handle restraint 660 retains the second bag handle 651D. In one embodiment, the handle restrains 658, 660 are positioned on oppose sides of the frame opening 666. Further, the handle restrains 658, 660 can be positioned between the bag support region 656 and the frame base region 664. In the embodiment illustrated in FIGS. 6A-6D, each of the handle restraints 658, 660 is shaped somewhat like a cane and includes a proximal end 668 that is secured to and extends upward from the frame base region 664 and a distal end 670 that is generally inverted "U" shaped. Alternatively, handle restraints 658, 660 can have a different design than that illustrated in FIGS. 6A-6D.

The backbone region 662 extends between the bag support region 656 and the frame base region 664 and maintains the bag support region 656 spaced apart from the frame base region 664. In the embodiment illustrated in FIGS. 6A-6D, the backbone region 662 includes a pair of spaced apart rod shaped beams. Alternatively, backbone region 662 can have a different design than that illustrated in FIGS. 6A-6D. For example, the backbone region 662 can include one or more cross members (not shown) that extend between the beams to provide additional support for the beams.

The frame base region 664 is designed to engage a horizontal surface 672 (illustrated in FIG. 6F) to hold the rest of the holder frame 652 and the bag opening 651A of the t-shirt bag 651 above the horizontal surface 672. In the embodiment illustrated in FIGS. 6A-6D, the frame base region 664 includes a pair of spaced apart arch shaped segments. Alternatively, the frame base region 664 can have a different design than that illustrated in FIGS. 6A-6F. In certain embodiments, as illustrated in FIG. 6D, the bag holder 650 maintains the bag bottom 651F above the frame base region 664.

Figure 6E:
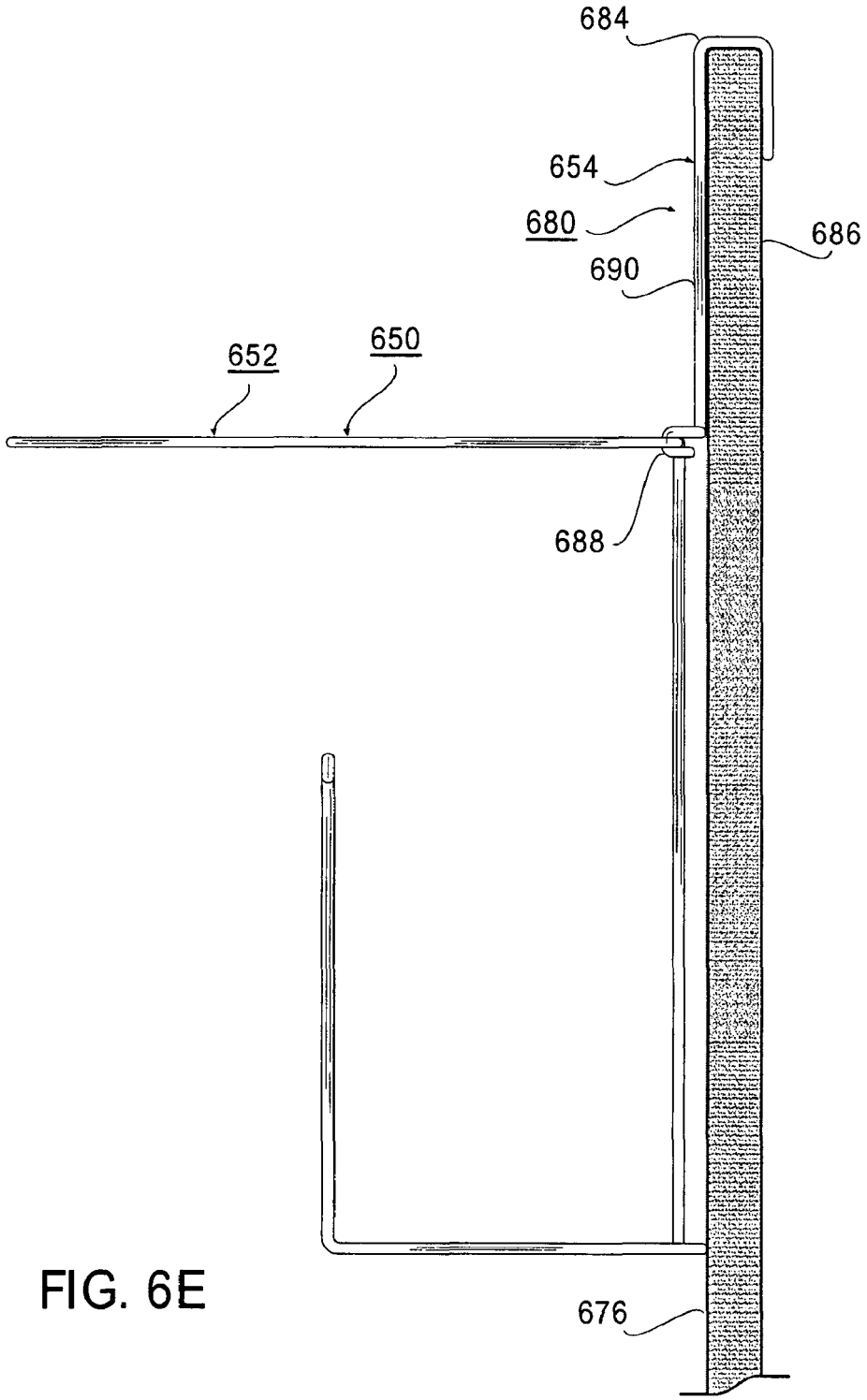
FIG. 6E is a side view of the bag holder of FIGS. 6A-6C with a holder handle in the attachment position securing the bag holder near a vertical surface.

Additionally, the holder frame 652 can include one or more frame bumpers 674 that maintain a portion of the holder frame 652 away from a vertical surface 676 (illustrated in FIG. 6E). In FIGS. 6A-6C, the holder frame 652 includes two rod shaped stand-offs 674 that extend away from the frame base region 664.

In one non-exclusive embodiment, the holder frame 652 can be made of one continuous, five gauge wire that is bent to form the bag frame 652. Alternatively, for example, the holder frame 652 can be made with (i) a wire that is a different gauge than five, (ii) a discontinuous wire, (iii) a tube, or (iv) another type of structure. Non-exclusive examples of suitable materials for the bag frame 652 include aluminum or steel.

Figure 6F:
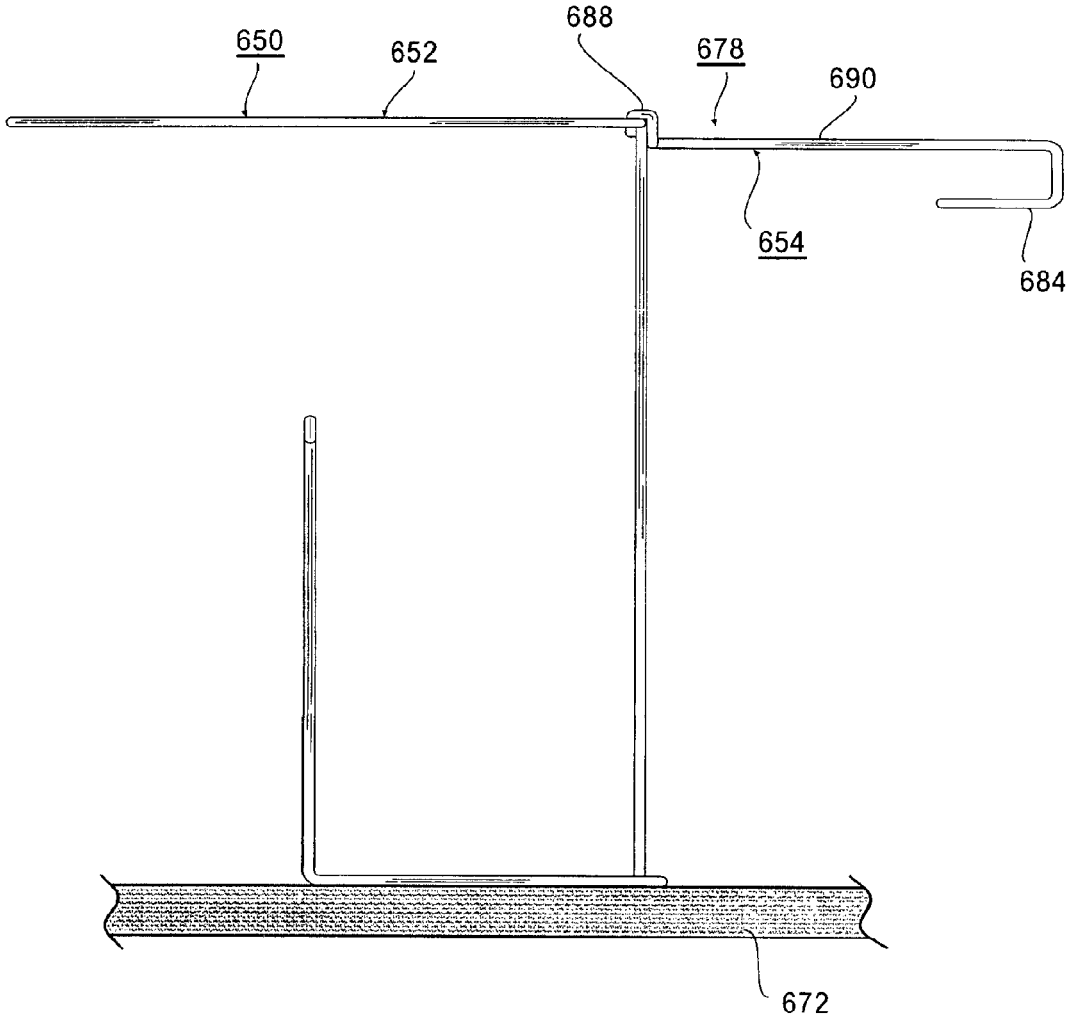
FIG. 6F is a side view of the bag holder of FIGS. 6A-6C with the holder handle on a vertical surface and the holder handle in the carrying position.

Referring additionally to FIGS. 6E and 6F, the holder handle 654 is secured to the holder frame 652 and movable relative to the holder frame 652 between a carrying position 678 (illustrated in FIG. 6F) in which the holder handle 654 can be used for carrying the holder frame 652 and the t-shirt bag 651, and an attachment position 680 (illustrated in FIG. 6E) in which that holder handle 654 is used for retaining the holder frame 652 and the t-shirt bag 651 near the vertical surface 676. In one embodiment, the holder handle 654 is substantially horizontally oriented (substantially parallel to the bag support region 656) in the carrying position 678 and the holder handle 654 is substantially vertically oriented (substantially perpendicular to the bag support region 656) in the attachment position 680. Additionally, in one embodiment, the holder handle 654 can pivot relative to the holder frame 652 about a handle axis of pivot 682 (illustrated in FIG. 6B) during movement between the positions 678, 680.

In one embodiment, the holder handle 654 includes a distal end 684 that defines a handle hook that engages a top of a door 686 (illustrated in FIG. 6E), a proximal end 688 that is pivotable secured to the holder frame 652, and a body region 690 that secures the distal end 684 to the proximal end 688. In this embodiment, the proximal end 688 includes a pair of spaced apart looped regions 692 that each encircle a portion of the bag support region 656 and a pair of spaced apart engagement regions 694 that selectively engage the backbone region 662. In this embodiment, the looped regions 692 allow the holder handle 654 to pivot relative to the holder frame 652 while the engagement regions 694 engage the backbone region 662 when the holder handle 654 is in the carrying position 678 to inhibit further rotation of the holder handle 654 so that the holder handle 654 can be used to carry the bag holder 650. Further, in this embodiment, the body region 690 includes a pair of spaced apart beams. Alternatively, the holder handle 654 can have a configuration that is somewhat different than that illustrated in Figures.

In one non-exclusive embodiment, the holder handle 654 can be made of one continuous, ten gauge wire that is bent to form the holder handle 654. Alternatively, for example, the holder handle 654 can be made with (i) a wire that is a different gauge than five, (ii) a discontinuous wire, (iii) a tube, or (iv) another type of structure. Non-exclusive examples of suitable materials for the holder handle 654 include aluminum or steel.

As provided above, FIG. 6E is a side view of the bag holder 650 with the holder handle 654 in the attachment position 680 securing the bag holder 650 to the door 686 that defines the vertical surface 676. Further, the FIG. 6F is a side view of the bag holder 650 with the bag holder 650 on the horizontal surface 672 with the bag handle 650 in the carrying position 678. With the designs provided herein, in certain embodiments, the bag holder 650 can be used to alternatively secure the t-shirt bag 651 to a door 686, holding at least a portion of the t-shirt bag 651 above the horizontal surface 672, or carrying the t-shirt bag 651.

In should be noted that in the embodiment illustrated in FIGS. 6A-6F, the holder handle 654 can slipped over and attached to the attachment beam 108 (illustrated in FIG. 1) instead being hung over the door 686. With this design, the bag holder 650 can be secured to the door 686 near the vertical surface 676 with the holder handle 654 not being visible from the other side of the door 686.

Figure 7A:
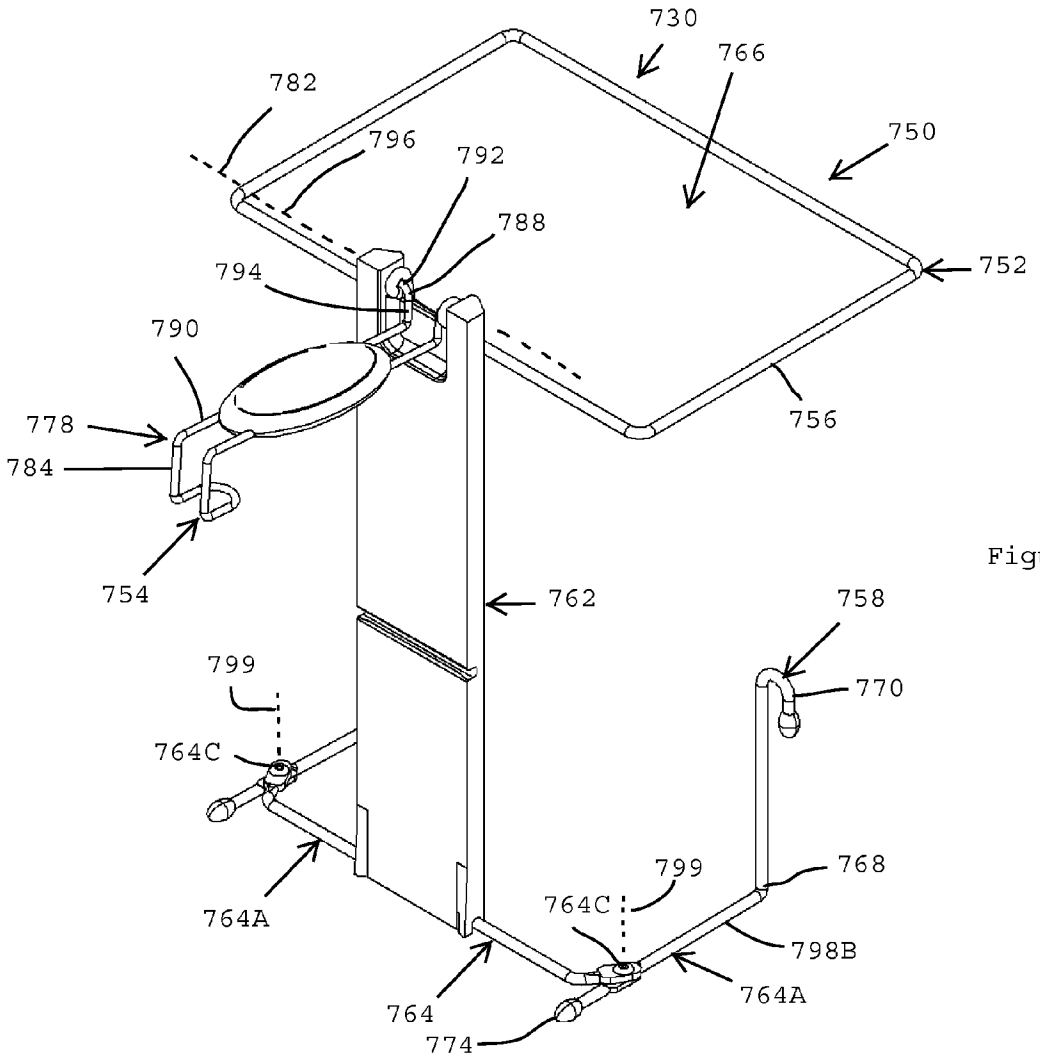
FIG. 7A is a perspective view of another embodiment of the bag holder in an expanded configuration.
Figure 7B:
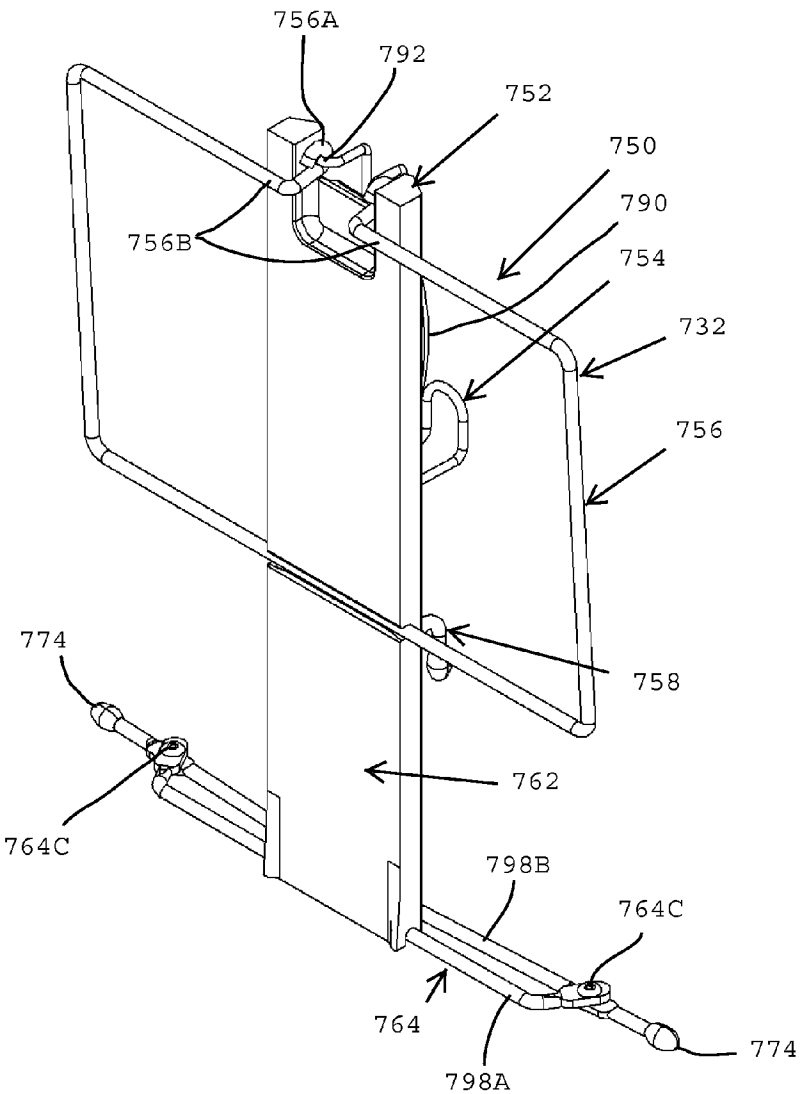
FIG. 7B is a perspective view of the bag holder of FIG. 7A in a compact configuration.
Figure 7C:
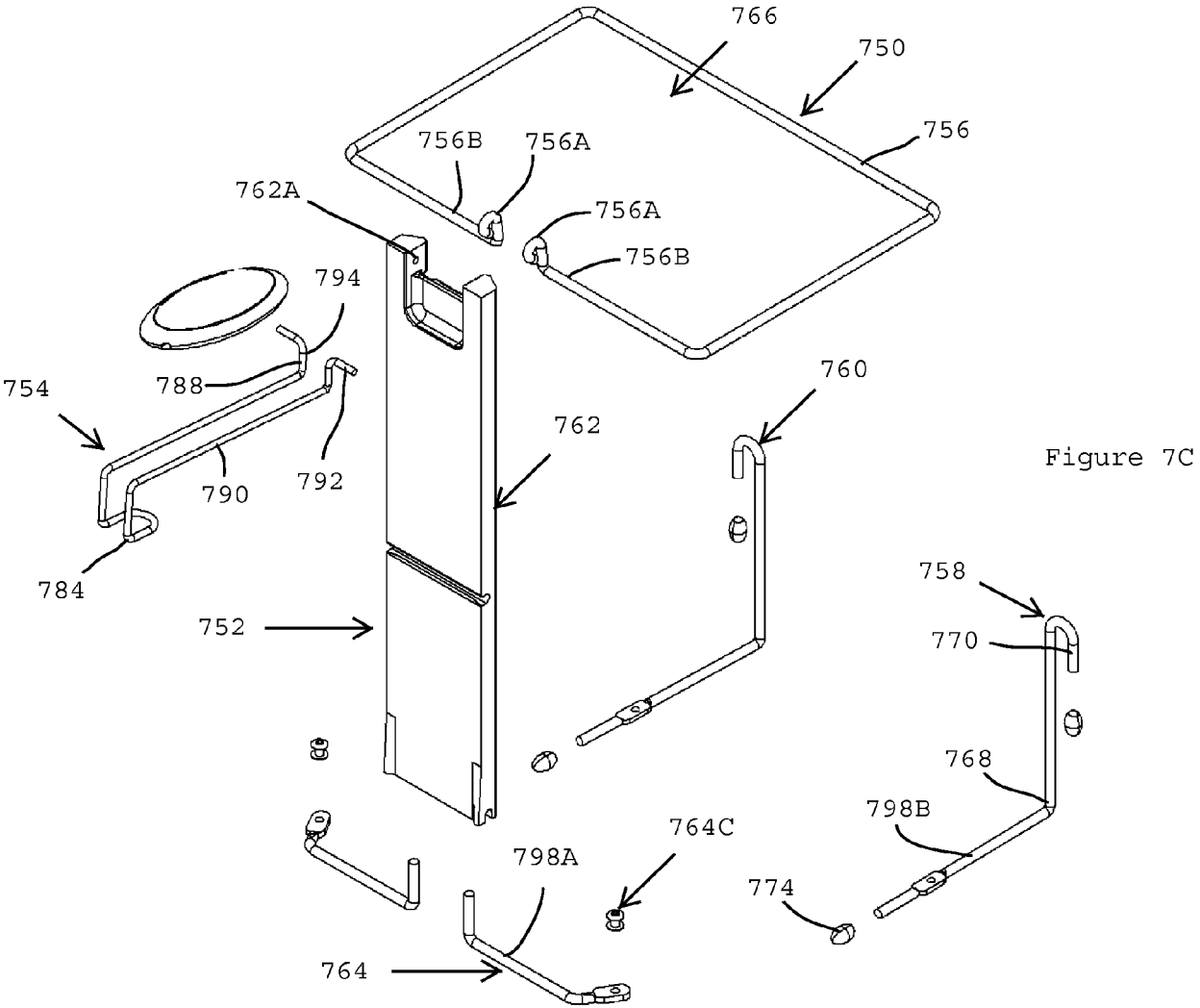
FIG. 7C is an exploded perspective view of the bag holder of FIG. 7A.

FIG. 7A is a perspective view of another embodiment of the bag holder 750 in an expanded configuration 730 for retaining a t-shirt type bag 651 (Illustrated in FIG. 6D); FIG. 7B is a perspective view of the bag holder 750 of FIG. 7A in a compact configuration 732; and FIG. 7C is an exploded perspective view of the bag holder 750 of FIG. 7A. It should be noted that the bag holder 750 illustrated in FIGS. 7A-7C is somewhat similar to the bag holders described above. However, in FIGS. 7A-7C, the bag holder 750 is selectively movable between (i) the expanded configuration 730 (illustrated in FIG. 7A) in which the bag holder 750 is configured for retaining a t-shirt type bag 651 (illustrated in FIG. 6D), and (ii) the compact configuration 732 (illustrated in FIG. 7B) in which the bag holder 750 is folded and in a more compact, configuration for shipping and storage. It should be noted that the bag holder 750 illustrated in FIG. 7A-7C has a generally rectangular configuration. Alternatively, the bag holder 750 can have a general oval configuration like that illustrated in FIGS. 6A-6F.

Similar to the embodiments described above, the bag holder 750 can be used in three different modes, namely (i) hung on a vertical surface, (ii) resting on a horizontal surface, or (iii) carried by the handle.

In one embodiment, the bag holder 750 includes a holder frame 752 and a holder handle 754. The size, shape, design, and materials used in each of these components can vary pursuant to the teachings provided herein. In this embodiment, the holder frame 752 includes a bag support region 756, a first handle restraint 758, a second handle restraint 760, a backbone region 762, and a frame base region 764.

The bag support region 756 supports the t-shirt type bag 651 with the bag opening held open. In one embodiment, the bag support region 756 is open rectangular frame shaped and forms a frame opening 766 for receiving a portion of the t-shirt bag 651.

The first handle restraint 758 restrains the first bag handle 651B, and the second handle restraint 760 retains the second bag handle 651D. In this embodiment, the handle restrains 758, 760 are positioned on oppose sides of the frame opening 766. Further, the handle restrains 758, 760 can be positioned between the bag support region 756 and the frame base region 764. In the embodiment illustrated in FIGS. 7A-7C, each of the handle restraints 758, 760 is shaped somewhat like a cane and includes a proximal end 768 that is secured to and extends upward from the frame base region 764 and a distal end 770 that is generally inverted "U" shaped. Alternatively, handle restraints 758, 760 can have a different design than that illustrated in FIGS. 7A-7C.

The backbone region 762 extends between the bag support region 756 and the frame base region 764 and maintains the bag support region 756 spaced apart from the frame base region 764. In the embodiment illustrated in FIGS. 7A-7C, the backbone region 762 is shaped somewhat similar to a flat plate. Alternatively, backbone region 762 can have a different design than that illustrated in FIGS. 7A-7C.

The frame base region 764 is designed to engage a horizontal surface 672 (illustrated in FIG. 6F) to hold the holder frame 752 and the bag opening 651A of the t-shirt bag 651 above the horizontal surface 672. In the embodiment illustrated in FIGS. 7A-7C, when in the expanded configuration 730, the frame base region 764 includes a pair of spaced "L" shaped segments 764A, 764B. Alternatively, the frame base region 764 can have a different design than that illustrated in FIGS. 7A-7C.

Additionally, the holder frame 752 can include one or more frame bumpers 774 that maintain a portion of the holder frame 752 away from the vertical surface 676 (illustrated in FIG. 6E). In FIGS. 7A-7C, the holder frame 752 includes two rod shaped stand-offs 774 that extend away from the frame base region 764.

The holder handle 754 is secured to the holder frame 752 and movable relative to the holder frame 752 between the carrying position 778 (illustrated in FIG. 7A) in which the holder handle 754 can be used for carrying the holder frame 752 and the t-shirt bag 651, and the attachment position 680 (illustrated in FIG. 6E) in which that holder handle 754 is used for retaining the holder frame 752 and the t-shirt bag 651 near the vertical surface 676. In one embodiment, the holder handle 754 is substantially horizontally oriented (substantially parallel to the bag support region 756) in the carrying position 778 and the holder handle 754 is substantially vertically oriented (substantially perpendicular to the bag support region 756) in the attachment position 680. In this embodiment, the holder handle 754 can be selectively pivoted relative to the holder frame 752 about a handle axis of pivot 782 (illustrated in FIG. 7A) during movement between the positions 778, 680.

In this embodiment, the holder handle 754 includes a distal end 784 that defines a handle hook that engages a top of a door 686 (illustrated in FIG. 6E), a proximal end 788 that is pivotable secured to the holder frame 752, and a body region 790 that secures the distal end 784 to the proximal end 788. In this embodiment, the proximal end 788 includes a pair of spaced apart beams 792 that fit into spaced apart apertures 762A (only one is illustrated in FIG. 7C) in the backbone region 762 and a pair of spaced apart engagement regions 794 that selectively engage the backbone region 762. In this embodiment, the beams 792 allow the holder handle 754 to pivot relative to the holder frame 752 while the engagement regions 794 engage the backbone region 762 when the holder handle 754 is in the carrying position 778 to inhibit further rotation of the holder handle 754 so that the holder handle 754 can be used to carry the bag holder 750. Further, in this embodiment, the body region 790 includes a pair of spaced apart beams. Alternatively, the holder handle 754 can have a configuration that is somewhat different than that illustrated in the Figures.

It should also be noted that the holder handle 754 can be rotated about the handle axis of pivot 782 to the compact configuration 732 in which the body region 790 of the holder handle 754 is substantially parallel to and adjacent to the backbone region 762. Comparing FIGS. 7A and 7B, the holder handle 754 has been rotated clockwise about the handle axis of pivot 782 to move the holder handle 754 from the carrying position 778 (illustrated in FIG. 7A) to the compact configuration 732 (illustrated in FIG. 7B) relative to the backbone region 762, the handle restraints 758, 760, and the bag support region 756. Further, the holder handle 754 can be rotated counter-clockwise about the handle axis of pivot 782 to move the holder handle 754 from the compact configuration 732 to the carrying position 778.

Stated in another fashion, the holder handle 754 pivots relative to the holder frame 752 in a first rotational direction during movement of the holder handle 754 from the compact configuration 732 to the carrying position 778, and wherein the holder handle 754 includes the engagement regions 794 that engage the backbone region 762 to inhibit rotation of the holder handle 754 past the carrying position 778 in the first rotational direction while simultaneously allowing the holder handle 754 to be freely rotated back to the compact configuration 732.

Further, the bag support region 756 can be rotated about a support region axis of pivot 796 from (i) the expanded configuration 730 (illustrated in FIG. 7A) in which the bag support region 756 is positioned to support the T-shirt bag, to (ii) the compact configuration 732 in which the bag support region 756 is substantially parallel to and adjacent to the backbone region 762. Comparing FIGS. 7A and 7B, the bag support region 756 has been rotated counter-clockwise about the support region axis of pivot 796 to move the bag support region 756 from the expanded configuration 730 to the compact configuration 732 (illustrated in FIG. 7B) relative to the backbone region 762, the handle restraints 758, 760, and the holder handle 754. Alternatively, the bag support region 756 can be rotated clockwise about the support region axis of pivot 796 to move the bag support region 756 from the compact configuration 732 to the expanded configuration 730.

In FIGS. 7A-7C, the bag support region 756 includes a spaced apart pair of loops 756A that encircle the beams 792 of the holder handle 754. With this design, the bag support region 756 can be pivoted about the beams 792 of the holder handle 754; and the support region axis of pivot 796 is approximately coaxial with the handle axis of pivot 782.

Additionally, it should be noted that the bag support region 756 includes a pair of spaced apart engagement regions 756B that selectively engage the backbone region 762 to inhibit further rotation of the bag support region 756 so that the bag support region 756 can be used to hold the T-shirt type bag. In this embodiment, the bag support region 756 is inhibited from further rotation in the clockwise direction from the expanded configuration 730 by the backbone region 762 while the engagement regions 756B engage the backbone region 762, but the bag support region 756 can be selectively rotated counterclockwise to the compact configuration 732.

Stated in another fashion, the bag support region 756 pivots relative to the holder frame in a first rotational direction during movement of the bag support region 756 from the contracted configuration 732 to the expanded configuration 730, and wherein the bag support region 756 includes the engagement region 756B that engage the backbone region 762 to inhibit rotation of the bag support region 756 past the expanded configuration 730 in the first rotational direction while simultaneously allowing the bag support region 756 to be freely rotated back from the expanded configuration 730 to the contracted configuration 732 in a second rotational direction.

Further, it should be noted that the handle restrains 758, 760 and a portion of the frame base region 764 can be rotated from (i) the expanded configuration 730 (illustrated in FIG. 7A) in which the frame base region 764 is in position to support the bag holder 750 and the handle restrains 758, 760 are positioned to support the T-shirt bag, to (ii) the compact configuration 732 (illustrated in FIG. 7B) in which the handle restrains 758, 760 are substantially parallel to and adjacent to the backbone region 762.

In one embodiment, each "L" shaped segments 764A, 764B of the frame base region 764 includes a pivot joint 764C that allows a portion of each "L" shaped segment 764A, 764B and its respective handle restraint 758, 760 to individually pivot relative to the backbone region 762 and the bag support region 756. Stated in another fashion, in one embodiment, each "L" shaped segment 764A, 764B includes (i) a generally straight first section 798A that is attached to the backbone region 762, (ii) a generally straight second section 798B that is attached to one of the handle restraints 758, 760, and (iii) a pivot joint 764C that pivotable connects the first section 798A to the second section 798B.

With this design, each handle restraint 758, 760 can be individually rotated about a separate restraint axis of pivot 799 to individually and selectively move the handle restraints 758, 760 between the compact configuration 732 and the expanded configuration 730. In the expanded configuration 730 the handle restraints 758, 760 are positioned away from the backbone region 762, and in the compact configuration 732 the handle restraints 758, 760 are adjacent to the backbone region 762.

While the particular bag holder as shown and disclosed herein is fully capable of obtaining the objects and providing the advantages herein before stated, it is to be understood that it is merely illustrative of the presently preferred embodiments of the invention and that no limitations are intended to the details of construction or design herein shown other than as described in the appended claims.

What is claimed is:

1. A bag holder for holding a t-shirt bag that includes a bag opening, a first bag handle and a second bag handle, the bag holder comprising:

a holder frame including (i) a first handle restraint that restrains the first bag handle, (ii) a second handle restraint that restrains the second bag handle, (iii) a separate bag support frame that supports the t-shirt type bag near the bag opening, and (iv) a backbone region; wherein the handle restraints and the bag support frame are coupled to the backbone region; and a holder handle that is secured to the holder frame, the holder handle being used for retaining the holder frame near a vertical surface; wherein the holder handle rotates relative to the holder frame between a carrying position in which the holder handle is used for carrying the holder frame, and an attachment position in which that holder handle is used for retaining the holder frame near a vertical surface; wherein the holder handle pivots relative to the holder frame in a first rotational direction during movement of the holder handle from the attachment position to the carrying position, and wherein the holder handle includes an engagement region that engages the backbone region of the holder frame to inhibit rotation of the holder handle past the carrying position in the first rotational direction while simultaneously allowing the holder handle to freely rotate between the attachment position and the carrying position;

wherein the holder frame is movable between (i) an expanded configuration in which the bag support frame and the handle restraints cooperate to maintain the bag opening open, with the bag support frame being spaced apart from the handle restraints, and (ii) a compact configuration in which at least one of the handle restraints has been moved relative to the bag support frame.

2. The bag holder of claim 1 wherein during movement from the expanded configuration to the compact configuration, each handle restraint has been moved relative to the bag support frame.

3. The bag holder of claim 2 wherein during movement from the expanded configuration to the compact configuration, the bag support frame has been moved relative to each handle restraint.

4. The bag holder of claim 1 wherein the holder frame includes a frame base region, and wherein during movement from the expanded configuration to the compact configuration, each handle restraint has been moved relative to the backbone region.

5. The bag holder of claim 4 wherein during movement from the expanded configuration to the compact configuration, the bag support frame has been moved relative to the backbone region.

6. The bag holder of claim 1 wherein the bag support frame is rigid and has a substantially tubular shape configuration.

7. The bag holder of claim 4 wherein the each handle restraint cantilevers upward from the frame base region and is positioned below the bag support frame.

8. A bag holder for holding a t-shirt bag that includes a bag opening, a first bag handle and a second bag handle, the bag holder comprising:

a holder frame including (i) a first handle restraint that restrains the first bag handle, (ii) a second handle restraint that restrains the second bag handle, (iii) a separate bag support frame that supports the t-shirt type bag near the bag opening, and (iv) a backbone region; wherein the handle restraints and the bag support frame are coupled to the backbone region; and a holder handle that is secured to the holder frame, the holder handle being used for retaining the holder frame near a vertical surface; wherein the holder handle rotates relative to the holder frame between a carrying position in which the holder handle is used for carrying the holder frame, and an attachment position in which that holder handle is used for retaining the holder frame near a vertical surface; wherein the holder handle pivots relative to the holder frame in a first rotational direction during movement of the holder handle from the attachment position to the carrying position, and wherein the holder handle includes an engagement region that engages the backbone region of the holder frame to inhibit rotation of the holder handle past the carrying position in the first rotational direction while simultaneously allowing the holder handle to freely rotate between the attachment position and the carrying position;

wherein the holder frame is movable between (i) an expanded configuration in which the bag support frame and the handle restraints cooperate to maintain the bag opening open, with the bag support frame being spaced apart from the handle restraints, and (ii) a compact configuration in which the bag support frame has been moved relative to the handle restraints.

9. The bag holder of claim 8 wherein during movement from the expanded configuration to the compact configuration, each handle restraint has been moved relative to the backbone region.

10. The bag holder of claim 9 wherein during movement from the expanded configuration to the compact configuration, the bag support frame has been moved relative to the backbone region.

11. A bag holder for holding a t-shirt bag that includes a bag opening, a first bag handle and a second bag handle, the bag holder comprising:

a holder frame including (i) a rigid backbone region, (ii) a first handle restraint that restrains the first bag handle, the first handle restraint being movably secured to the backbone region, (iii) a second handle restraint that restrains the second bag handle, the second handle restraint being movably secured to the backbone region, and (iv) a separate bag support frame that supports the t-shirt type bag near the bag opening, the bag support frame being movably secured to the backbone region;

wherein the holder frame is movable between (i) an expanded configuration in which the bag support frame and the handle restraints cooperate to maintain the bag opening open, with the bag support frame being spaced apart from the handle restraints, and (ii) a compact configuration in which the handle restraints and the bag support frame have been moved relative to the backbone region.

12. The bag holder of claim 11 further comprising a holder handle that is secured to the holder frame, the holder handle being used for retaining the holder frame near a vertical surface.

13. The bag holder of claim 12 wherein the holder handle rotates relative to the holder frame between a carrying position in which the holder handle is used for carrying the holder frame, and an attachment position in which that holder handle is used for retaining the holder frame near a vertical surface; wherein the holder handle pivots relative to the holder frame in a first rotational direction during movement of the holder handle from the attachment position to the carrying position, and wherein the holder handle includes an engagement region that engages the backbone region of the holder frame to inhibit rotation of the holder handle past the carrying position in the first rotational direction while simultaneously allowing the holder handle to freely rotate between the attachment position and the carrying position.

14. The bag holder of claim 11 further comprising a frame base region that is secured to the backbone region, the frame base region being designed to engage a horizontal surface to support the bag holder above the horizontal surface.

15. The bag holder of claim 14 wherein the each handle restraint cantilevers upward from the frame base region and is positioned below the bag support frame.

16. The bag holder of claim 11 wherein the bag support frame is rigid and has a substantially tubular shape configuration.

* * * * *